US009150948B2

(12) United States Patent
Dambrine et al.

(10) Patent No.: US 9,150,948 B2
(45) Date of Patent: Oct. 6, 2015

(54) METHOD FOR MANUFACTURING AN INTEGRAL ROTATIONALLY SYMMETRICAL METAL PART INCLUDING A REINFORCEMENT CONSISTING OF CERAMIC FIBERS

(75) Inventors: Bruno Jacques Gerard Dambrine, Le Chatelet en Brie (FR); Thierry Godon, Sevran (FR)

(73) Assignee: SNECMA, Paris (FR)

( * ) Notice: Subject to any disclaimer, the term of this patent is extended or adjusted under 35 U.S.C. 154(b) by 147 days.

(21) Appl. No.: 14/002,538

(22) PCT Filed: Mar. 2, 2012

(86) PCT No.: PCT/FR2012/050448

§ 371 (c)(1), (2), (4) Date: Aug. 30, 2013

(87) PCT Pub. No.: WO2012/117213

PCT Pub. Date: Sep. 7, 2012

(65) Prior Publication Data

US 2013/0340226 A1 Dec. 26, 2013

(30) Foreign Application Priority Data

Mar. 2, 2011 (FR) ..... 11 51706

(51) Int. Cl.

| | |
|---|---|
| ***B23P 17/00*** | (2006.01) |
| ***C22C 47/06*** | (2006.01) |
| ***B22F 3/15*** | (2006.01) |
| ***C22C 47/04*** | (2006.01) |

(52) U.S. Cl.

CPC . *C22C 47/06* (2013.01); *B22F 3/15* (2013.01); *C22C 47/04* (2013.01); *C22C 47/064* (2013.01); *Y10T 29/49799* (2015.01); *Y10T 29/49801* (2015.01)

(58) Field of Classification Search

CPC ..... B22F 3/15; C22C 47/06; C22C 47/04; C22C 49/00; C22C 47/064; Y10T 29/49799; Y10T 29/49801

See application file for complete search history.

(56) References Cited

U.S. PATENT DOCUMENTS

| | | | | |
|---|---|---|---|---|
| 5,557,846 | A * | 9/1996 | Wei et al. | 29/889.2 |
| 6,658,715 | B1 | 12/2003 | Podesta | |
| 7,005,598 | B2 * | 2/2006 | Andrees et al. | 219/121.14 |
| 2003/0029904 | A1 | 2/2003 | Pursell | |
| 2007/0045251 | A1 | 3/2007 | Franchet et al. | |

FOREIGN PATENT DOCUMENTS

| | | |
|---|---|---|
| EP | 1 726 678 | 11/2006 |

OTHER PUBLICATIONS

International Search Report Issued May 4, 2012 in PCT/FR12/050448 Filed Mar. 2, 2012.

* cited by examiner

*Primary Examiner* — Ryan J Walters

(74) *Attorney, Agent, or Firm* — Oblon, McClelland, Maier & Neustadt, L.L.P.

(57) ABSTRACT

A method for manufacturing an integral rotationally symmetrical part, which includes producing a blank of the part around a cylindrical mandrel, the blank including at least one fibrous structure made of composite ceramic fibers coated with metal, followed by a diffusion-welding treatment of the blank by hot isostatic pressing, and optionally machining the thus-treated blank to obtain the part. The blank includes at least a first metal-wire layer between the mandrel and the composite fibrous structure, and at least a second metal-wire layer arranged around the composite fibrous structure to cover the composite fibrous structure.

10 Claims, 2 Drawing Sheets

METHOD FOR MANUFACTURING AN INTEGRAL ROTATIONALLY SYMMETRICAL METAL PART INCLUDING A REINFORCEMENT CONSISTING OF CERAMIC FIBERS

TECHNICAL FIELD OF THE INVENTION

The present invention relates to a method for manufacturing a single-piece, hollow metal part of revolution, such as a torque transmission shaft, from a composite fibrous structure in the form of fibers, lap, fiber fabric, and other such materials, said fibers being coated with metal.

PRIOR ART

In order to address the ongoing pressures to reduce specific consumption, efforts are being made to replace certain forged parts in a turbomachine with lighter parts of simpler structure. Such is the case with the power transmission shaft between the main shaft of a jet engine and its gearbox driving the accessory machines of the engine, referred to in the field by the acronym AGB. This is a thin shaft that is relatively long, of the order of a meter, for large-diameter engines and for which it is necessary to provide, in addition to the ends, an intermediate bearing to ensure its support and the transfer of the specific vibratory frequency modes.

The importance of composite materials in the partial or total production of parts has emerged in recent years, in many technical fields, notably aeronautics, space, military, automobile, etc., because of the optimization of the resistance of such materials, for minimal weight and bulk. As a reminder, such a fibrous structure made of composite material comprises a metal alloy matrix, for example of titanium Ti alloy, within which extend fibers, for example ceramic fibers of silicon carbide SiC. Such fibers exhibit a tensile strength much greater than that of titanium (typically, 4000 MPa compared to 1000 MPa). It is therefore the fibers which take up the forces, the metal alloy matrix acting as a binder for the part, and providing protection and insulation for the fibers, which must not come into contact with one another. Furthermore, the ceramic fibers are resistant to erosion, but necessarily have to be coated with metal.

These composite materials can be used to produce annular turbomachine parts of revolution for aircraft or for other industrial applications, such as rings, shafts, cylinder bodies, casings, spacers, monolithic part reinforcements such as blades, etc.

One known method for manufacturing hollow parts of revolution with a single-piece structure consists in superposing, around a cylindrical mandrel, successive fibrous structures (fibers, lap or fiber fabric) and then arranging the wound composite fibrous structures in a specific receiving outfit to compact and bind the latter by diffusion welding and ultimately obtain the part of revolution in composite material. A method for manufacturing a part of revolution by lap lay-up is described in the Patent Application EP1726 678, in the name of the applicant.

Another known method consists in winding ceramic, but not coated, fibers around a mandrel by inserting metal wires between the ceramic fibers.

DESCRIPTION OF THE INVENTION

The applicant set out to develop a method that makes it possible to produce parts of revolution with a diameter that can be very small, of the order of the diameter of the wires used, but also very high, being limited only by the bulk of the outfit and with a length that depends on only the means used.

Thus, the subject of the invention is a method for manufacturing a single-piece part of revolution comprising the production of a preform of the part around a cylindrical mandrel, the preform comprising at least one fibrous structure formed by metal-coated ceramic composite fibers, followed by the diffusion welding treatment of the preform by hot isostatic compaction, and the appropriate machining of the duly treated preform to obtain the part, and the method is characterized in that the preform comprises at least one first layer of metal wire between the mandrel and said composite fibrous structure and at least one second layer of metal wire around said composite fibrous structure so as to embed the latter.

The method of the invention thus makes it possible to obtain a part that exhibits sufficient stiffness without increasing its density and, in the case of a torque transmission shaft such as that mentioned above, to increase the ratio of Young's modulus to density, to raise the specific vibratory frequency modes of the part and therefore, possibly, to produce a shaft with no intermediate bearing.

Advantageously, the mandrel is in two tapered parts that can be separated from one another and form a bobbin. This way, the preform after compaction can be stripped from the mold without difficulty. The first layer of metal wire is preferably adapted so as to exhibit, after compaction of the preform, a cylindrical portion forming, after machining, the inner wall of the part. The layer of metal wire can be formed by winding one or more metal wires around the mandrel.

The metal wire is, for example, obtained by wire drawing and is of the same type as that which coats the composite fibers; in this way, after passage through the outfit, a uniform metal layer of appropriate thickness is obtained on the fibers of the reinforcing structures.

The method of the invention also offers the advantage of being able to effect cold, at ambient temperature, the superposed layers of metal wire and of the fibrous structure.

According to another feature of the method, the coated fibers of the fibrous structure are arranged in one and the same direction, preferably the axial direction of the part.

More particularly, the composite fibrous structure is formed by winding metal composite laps or fiber fabrics.

According to another feature, the layers are at least partly linked together by bonding, welding or by means of foils.

According to another particular embodiment, transverse radial ribs are formed, notably at the longitudinal ends of the part, by winding metal wire. These transverse ribs can be machined and form the gear pinions for example. According to one production variant, a ceramic fiber reinforcement is incorporated in said transverse ribs.

Moreover, the metal wires used can have different diameters, and layers with several superposed windings of these wires can be provided in alternation with the superposed fibrous structures, the number of which can be greater than two.

BRIEF DESCRIPTION OF THE DRAWINGS

The figures of the appended drawing will give a clear understanding as to how the invention can be produced. In these figures, identical references designate similar elements.

DETAILED DESCRIPTION OF THE INVENTION

Figure 1:
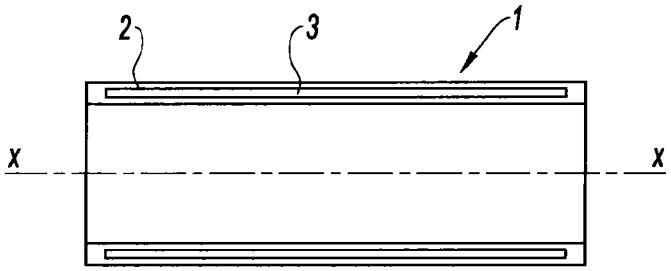
FIG. 1 schematically shows an example of a cylindrical part that can be obtained with the method of the invention.

The aim of the method is to manufacture an annular, single-piece part of revolution 1, only from elongate elements in the form of wires, fibers or similar, as will be seen hereinbelow. The invention targets more particularly the formation of parts with a long length compared to their diameter. FIG. 1 shows, in longitudinal cross section, the cylindrical hollow part with metal wall 2, of axis XX, and incorporating reinforcing fibers 3, of ceramic material, in one or more layers, preferably all the fibers of one and the same layer having one and the same orientation, such as axial.

To obtain this type of part, a cylindrical mandrel 10 is used, of longitudinal axis X, around which the part is formed. The mandrel is preferably in the form of a bobbin, in two tapered parts 10*a* and 10*b* which are fastened to one another by their apex, in a removable manner so as to be able to separate them from one another. The half-angle alpha at the apex of the two cones, exaggerated in the figure, is of the order of 6 to 7°. The aim of the bobbin shape is to enable the part to be stripped from the mold after compaction of the wires and fibers as will be seen hereinbelow. In a first step, a metal wire 4 is wound around the cylinder so as to form a first layer of metal wire. Given the application of the part 1 to the aeronautical field, the metal wire 4 is notably made of a titanium alloy of TiA6V or TI6242 type ensuring thermomechanical resistance and lightness, and it is obtained notably by wire drawing so as to be able to be available in bobbin or reel form from which the wire is drawn.

Means other than wire drawing can be envisaged.

Dimensionally, its diameter depends on the part to be obtained and can be of the order of a few tenths of a millimeter to several millimeters.

Figure 2:
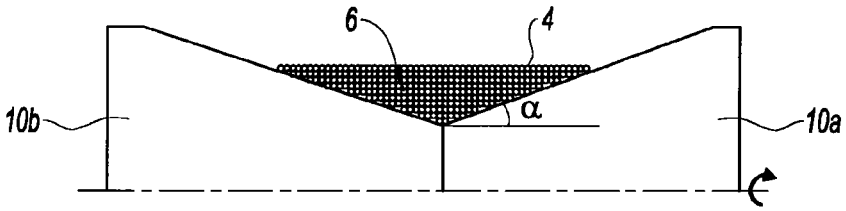
FIG. 2 shows the step of formation of the first layer of metal wire of the part preform according to one embodiment of the invention.

In the example illustrated in FIG. 2, the drawn metal wire 4 is obtained from a reel which is not represented and is driven, substantially perpendicularly to the axis X, around the cylindrical mandrel 10 over a predetermined extent corresponding to the length that is to be obtained, after manufacture, for the part of revolution 1, by thus forming a number of contiguous turns, and over one or more superposed thicknesses so as to form the first layer of metal wire 6. It would also be possible to use a plurality of metal wires or one or more metal wires with a different diameter to the metal wire 4. Because of the taper of the cylinder 10, the first layer has a triangular longitudinal section. One of the functions of the layer 6 is to fill the mold stripping part to the internal diameter of the finished part, after its machining.

Figure 3:
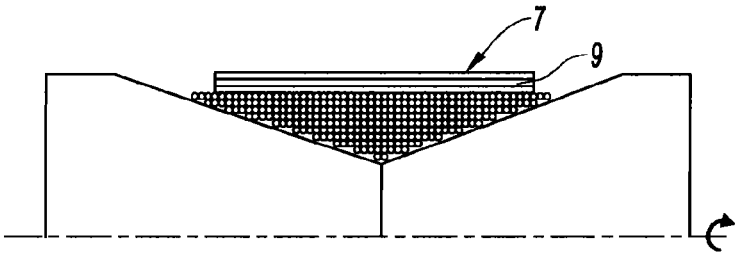
FIG. 3 shows the step of formation of the layer of fibrous structure in coated ceramic fibers.

The method continues with a second step shown in FIG. 3 and consisting in arranging a composite fibrous structure 7 around the first layer 6 of metal wire 4.

The composite fibrous structure 7 may take the form of a fabric of mutually parallel associated coated ceramic fibers 9 made of ceramic (SiC) or of a similar material coated with metal. The latter and the metal of the drawn wire are preferably of identical type (of TiA6V or of 6242 for example) to optimize the subsequent step of the method concerning the hot isostatic compaction operation. The fabric of the fibrous structure 7 is wound around the winding of the first layer 6 of metal wire 4 so that the fibers 9 are all arranged according to the same orientation, for example and preferably parallel to the longitudinal axis X of the mandrel 10.

A single layer of the fabric is formed around the first layer of wire 4. Obviously, a winding of several layers could be provided from the same fabric, or even from one or more other distinct fabrics wound concentrically. The fabrics may be of different species, of different coated wire diameters. The length of the composite fibrous structure 7 is less than or equal to the length of the outer surface of the first layer 6 of metal wire. It should be noted that the outer surface of the latter may be domed to take account of the compaction of the layer 6 by hot isostatic compression treatment. After this treatment, this surface should preferably be straight cylindrical.

Figure 4:
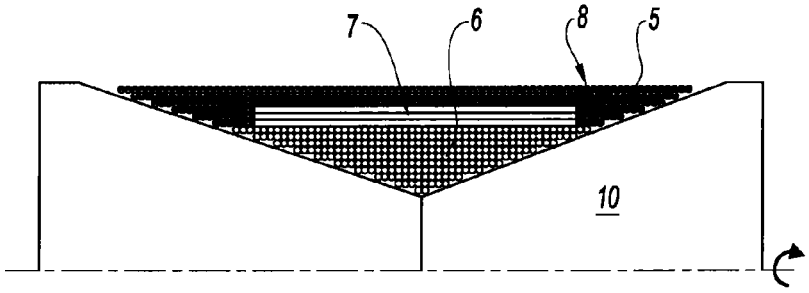
FIG. 4 shows the step of formation of the second layer of metal wire.

According to a third step of the method illustrated in light of FIG. 4, a metal wire 5, for example wire drawn, from a reel not represented and which is fed in substantially orthogonally to the longitudinal axis X of the rotary cylindrical mandrel 10, is arranged around the fabric of the composite fibrous structure 7. The metal wire 5 forms a second layer 8 of contiguous turns around the fabric of the fibrous structure 7. The second layer 8 may comprise a winding of several thicknesses. Also, as for the first layer, instead of winding one metal wire, a plurality of metal wires or a sheet of metal wires can be put in place. When using a plurality of wires, the latter may be of the same diameter or of different diameters. The wires may also be metal wires preassembled in the form of cables. Layers of foil may also be wound with the second layer. According to one feature of the method, the metal wire or wires 5 is/are wound in such a way as to fully embed the composite fibers of the underlying fibrous structure 7. As can be seen in FIG. 4, in particular, the second layer 8 covers the part of the first layer 6 of metal wire which is not itself covered by the fibrous structure 7.

A preform E of the part of revolution to be produced is obtained, which is made only from metal wires 4 and 5 and a structure 7 with composite fibers in individual form, in lap form, in fabric form or similar.

Figure 5:
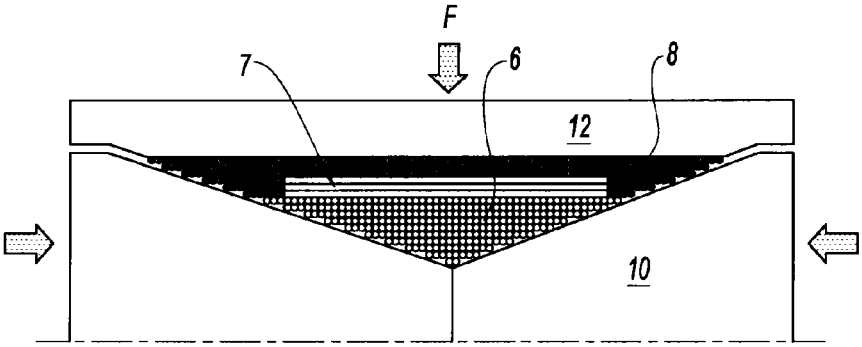
FIG. 5 schematically shows the step of hot isostatic compaction of the preform.

Then, as FIG. 5 shows, the preform E is subjected to hot isostatic compression treatment (CIC) in an isothermal press or in a bag in an autoclave (the choice depending notably on the number of parts to be produced). A cover system of complementary shape is fitted over the preform. Since the preform is cylindrical, the cover, in a plurality of parts, forms a cylindrical jacket around the preform.

Under the compression exerted (as a result of a high pressure applied according to the arrow F) at an appropriate high temperature, the metal of the metal wires and of the cladding of the fibers of the structures becomes pasty and creeps, eliminating all the empty spaces between the turns and layers, their diffusion welding then finally densifying the part.

In a variant, the assembly is placed in a deformable pocket of mild steel which is then introduced into an autoclave. This autoclave is raised to an isostatic pressure of 1000 bar and a temperature of 940° C. (for TiA6V), so that all of the pocket is deformed by shrinking through the evacuation of the air and is pressed against the mandrel and the cover which, in their turn, compress, under a uniform pressure, the windings of wire and fiber until the metal of which they are made creeps and is bound by diffusion welding. Advantageously, a number of pockets can thus be introduced into the autoclave in order to simultaneously produce the parts, reducing the manufacturing costs.

Thus, after the CIC treatment, cooling and mold-stripping have stopped, the preform is machined to obtain the composite single-piece part of revolution 1, represented in FIG. 1, which is made of metal with, at its core, the fibers forming reinforcing inserts.

The outfit formed by the cylindrical mandrel 10 and the cover system is preferably made of a material which enables it to be used again for the manufacture of another part. It is, for example, a superalloy which withstands the temperature and the pressure of the treatment while retaining its integrity.

Obviously, the direction of orientation of the fibers could be different from that described above (parallel to the axis of the mandrel), in the same way as the choice of a fabric as internal fibrous structure is in no way mandatory, since any other choice can be envisaged. It must also be stipulated that the steps of winding the wires and the fibrous structures are performed at ambient temperature without using a complex installation.

As examples, the coated composite fibers may be, in addition to SiC/Ti as described above, made of SiC/AI, SiC/SiC, SiC/B, etc.

Dimensionally, the minimum radius of the mandrel is a function of the diameter of the metal wire and must be greater than the latter. As far as the length of the part is concerned, it can be as long as several meters if necessary.

Figure 6:
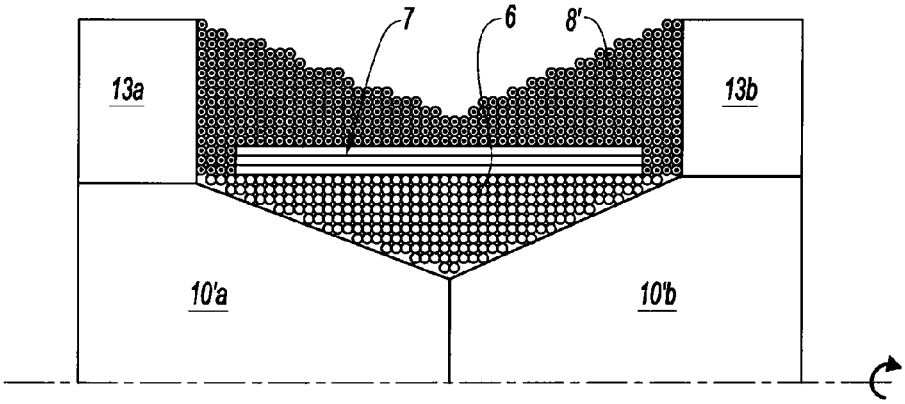
FIGS. 6 and 7 show a variant implementation of the method of the invention.
Figure 7:
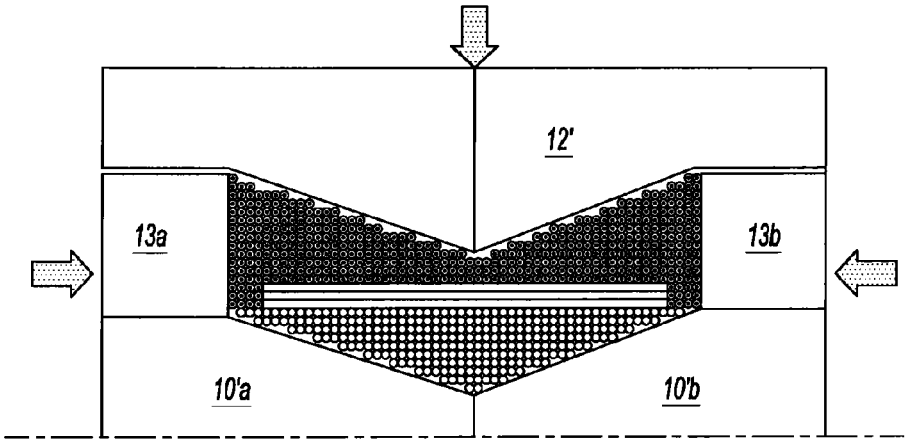

According to a variant implementation, represented in FIGS. 6 and 7, flanges 13*a* and 14*b* are added to the mandrel, on the side of the free ends of the half-mandrels 10'*a* and 10'*b*, so as to complement the support of the second layer 8' of metal wire when the latter has a diameter greater than that of the mandrel 10'*a*, 10'*b*. The thickness of the different layers applied takes account of their expansion, with a view to the result that is desired after CIC treatment. The cover system 12' as represented in FIG. 7 is adapted to the outer geometry of the preform.

Figure 8:
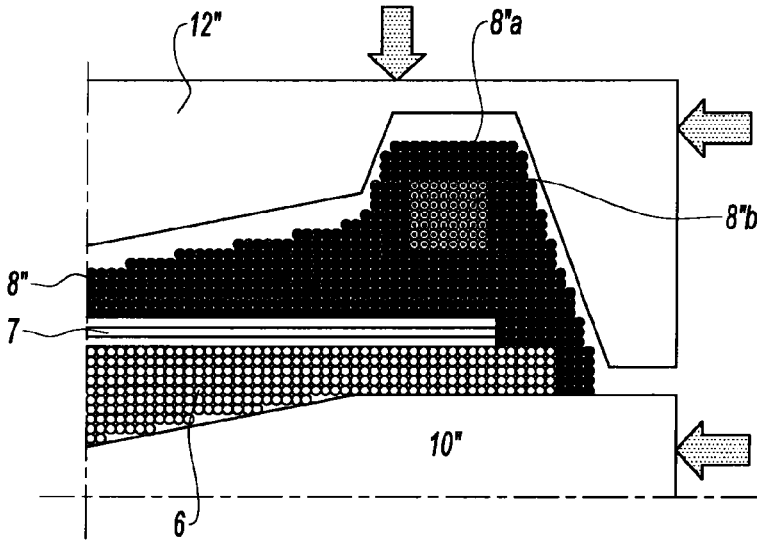
FIG. 8 shows another variant implementation of the method of the invention for the production of a part having a transverse radial rib.

According to another production variant, the method of the invention makes it possible to manufacture parts in dumbbell form, that is to say with transverse radial ribs. To obtain them, it is sufficient to adapt the geometry of the second layer so as to form these ribs. The thickness of this second layer is increased for this purpose in the desired position. Thus, FIG. 8 shows a detail of the preform produced in this way. The second layer 8" of metal wire is formed by winding metal wire so as to exhibit a part forming a transverse rib 8"*a*, this rib after the CIC treatment forming a transverse radial rib on the part. The function of this rib may be a terminal fixing flange or a pinion after machining radial teeth.

In order to further reinforce the mechanical strength of this rib, ceramic fibers 8"*b* of a length adapted to the width of the rib after CIC can be included. If the reinforcing fibers are oriented transversely to the axis of the part, then they can be put in place by winding in the same way as are the metal wires. If the orientation chosen for the reinforcing fibers has to be axial, then they will be put in place in the form of laps or fabric like the reinforcing layer 7.

It will be observed that the shape of the cover 12" is also adapted to that of the part preform produced on the mandrel 10".

The invention claimed is:

1. A method for manufacturing a single-piece part of revolution, comprising:

producing a preform of the part around a cylindrical mandrel, the preform comprising at least one fibrous structure formed by metal-coated ceramic composite fibers;

diffusion welding treatment of the preform by hot isostatic compaction; and machining of the preform to obtain the part, the preform comprises at least one first layer of metal wire between the mandrel and the fibrous structure and at least one second layer of metal wire around the fibrous structure so as to embed the fibrous structure, the mandrel comprising two tapered parts that can be separated from one another.

2. The method as claimed in claim 1, wherein the first layer of metal wire is configured to form, after the compaction of the preform, a cylindrical portion capable of forming, after the machining, an inner wall of the part.

3. The method as claimed in claim 1, wherein the first layer of metal wire is formed by winding one or more metal wires around the mandrel.

4. The method as claimed in claim 1, wherein the metal wire is of type obtained by wire drawing and of same type of metal as that which coats the composite fibers.

5. The method as claimed in claim 1, wherein different layers are put in place at ambient temperature.

6. The method as claimed in claim 1, wherein the coated fibers of the fibrous structure are arranged in one and same direction, or an axial direction of the part.

7. The method as claimed in claim 6, wherein the fibrous structure is formed by winding one or more laps or fabrics of parallel metal composite fibers or of individual and parallel fibers arranged in succession around the mandrel.

8. The method as claimed in claim 1, wherein the layers are at least partly linked together by bonding, welding, or by foils.

9. The method as claimed in claim 1, wherein transverse radial ribs are formed, at longitudinal ends of the preform, by winding metal wire.

10. The method as claimed in claim 9, wherein a ceramic fiber reinforcement is incorporated in the transverse ribs.

* * * * *